US011450996B2

(12) United States Patent
Wiebe et al.

(10) Patent No.: US 11,450,996 B2
(45) Date of Patent: Sep. 20, 2022

(54) CONNECTOR ASSEMBLY FOR CONNECTING A CABLE TO AN ELECTRICAL COMPONENT

(71) Applicant: MD ELEKTRONIK GmbH, Waldkraiburg (DE)

(72) Inventors: Rudolf Wiebe, Kraiburg am Inn (DE); Stefan Sperr, Reichertsheim (DE); Johannes Eben, Schechen (DE); Matthias Plischke, Ampfing (DE); Christian Kirschner, Wurmannsquick (DE); Andreas Hoisl, Muehldorf am Inn (DE); Sebastian Mirz, Kraiburg am Inn (DE)

(73) Assignee: MD ELEKTRONIK GMBH, Waldkraiburg (DE)

( * ) Notice: Subject to any disclaimer, the term of this patent is extended or adjusted under 35 U.S.C. 154(b) by 0 days.

(21) Appl. No.: 17/183,356

(22) Filed: Feb. 24, 2021

(65) Prior Publication Data

US 2021/0281025 A1 Sep. 9, 2021

(30) Foreign Application Priority Data

Mar. 9, 2020 (DE) ..... 10 2020 106 244.3

(51) Int. Cl.
*H01R 24/44* (2011.01)
*H01R 4/18* (2006.01)
*H01R 103/00* (2006.01)

(52) U.S. Cl.
CPC ..... *H01R 24/44* (2013.01); *H01R 4/183* (2013.01); *H01R 2103/00* (2013.01)

(58) Field of Classification Search
CPC ..... H01R 2103/00; H01R 9/05–053; H01R 24/44; H01R 4/183
USPC ..... 439/578–585
See application file for complete search history.

(56) References Cited

U.S. PATENT DOCUMENTS

| | | | | |
|---|---|---|---|---|
| 3,103,548 | A | 9/1963 | Concelman | |
| 4,917,630 | A | 4/1990 | Hubbard | |
| 2002/0182934 | A1 | 12/2002 | Endo et al. | |
| 2019/0148867 | A1* | 5/2019 | Saeki | H01R 13/15 439/474 |

FOREIGN PATENT DOCUMENTS

| | | | |
|---|---|---|---|
| DE | 1515398 | B | 4/1970 |
| DE | 69404863 | T2 | 11/1997 |

* cited by examiner

*Primary Examiner* — Gary F Paumen
(74) *Attorney, Agent, or Firm* — Leydig, Voit & Mayer Ltd.

(57) ABSTRACT

A connector assembly for connecting a cable to an electrical component includes an outer conductor sleeve and an insulator element. The outer conductor sleeve has an attachment portion and a plug portion. The insulator element is disposed within the outer conductor sleeve, at least partially in the plug portion. The cable is disposed with a cable end portion at least partially within the outer conductor sleeve in the attachment portion. The outer conductor sleeve has at least a first wall thickness region having a first wall thickness in the attachment portion and at least a second wall thickness region having a second wall thickness in the plug portion, the first wall thickness being greater than the second wall thickness. The insulator element is at least partially disposed in the second wall thickness region.

19 Claims, 2 Drawing Sheets

CONNECTOR ASSEMBLY FOR CONNECTING A CABLE TO AN ELECTRICAL COMPONENT

CROSS-REFERENCE TO PRIOR APPLICATION

Priority is claimed to German Patent Application No. DE 10 2020 106 244.3, filed on Mar. 9, 2020, the entire disclosure of which is hereby incorporated by reference herein.

FIELD

The invention relates to a connector assembly for connecting a cable to an electrical component.

BACKGROUND

Today, due to the increasing digitization of components and systems and the associated increasing amount of data to be transmitted, increasingly higher demands are being placed on the cables required for transmission. In particular, a constantly high signal transmission quality over large frequency ranges combined with low, or at least constant attenuation over the respective frequency range plays an increasingly central role.

In order to meet these requirements, use is made of radio-frequency cables, such as coaxial cables. The coaxial arrangement of the inner conductor, the dielectric, and the shield largely ensures high signal transmission quality combined with low attenuation and low susceptibility to interference, provided the coaxial configuration and the associated line impedance are maintained substantially constant over the entire length of the electrical cable. However, the cable ends, on which typically connector systems are mounted to electrically conductively and communicatively connect the cable to the components or other cables between which data is to be transmitted, are problematic in this context. Furthermore, it is typically desired for the connection to be releasable.

However, such connector systems, which may be in the form of a plug-and-socket connector, have the disadvantage that it is very difficult to achieve a constant impedance, for example, because the dimensioning of the respective connector system cannot be selected merely on the basis of the desired impedance since, at the same time, sufficient stability must be ensured in order to produce the connector system in a reliable process, and in particular because a stable and strong connection must be achievable between the connector system and the respective connection partner.

SUMMARY

In an embodiment, the present invention provides a connector assembly for connecting a cable to an electrical component. The connector assembly includes an outer conductor sleeve and an insulator element. The outer conductor sleeve has an attachment portion and a plug portion. The insulator element is disposed within the outer conductor sleeve, at least partially in the plug portion. The cable is disposed with a cable end portion at least partially within the outer conductor sleeve in the attachment portion. The outer conductor sleeve has at least a first wall thickness region having a first wall thickness in the attachment portion and at least a second wall thickness region having a second wall thickness in the plug portion, the first wall thickness being greater than the second wall thickness. The insulator element is at least partially disposed in the second wall thickness region

BRIEF DESCRIPTION OF THE DRAWINGS

Embodiments of the present invention will be described in even greater detail below based on the exemplary figures. The present invention is not limited to the exemplary embodiments. All features described and/or illustrated herein can be used alone or combined in different combinations in embodiments of the present invention. The features and advantages of various embodiments of the present invention will become apparent by reading the following detailed description with reference to the attached drawings which illustrate the following.

DETAILED DESCRIPTION

Figure 1:
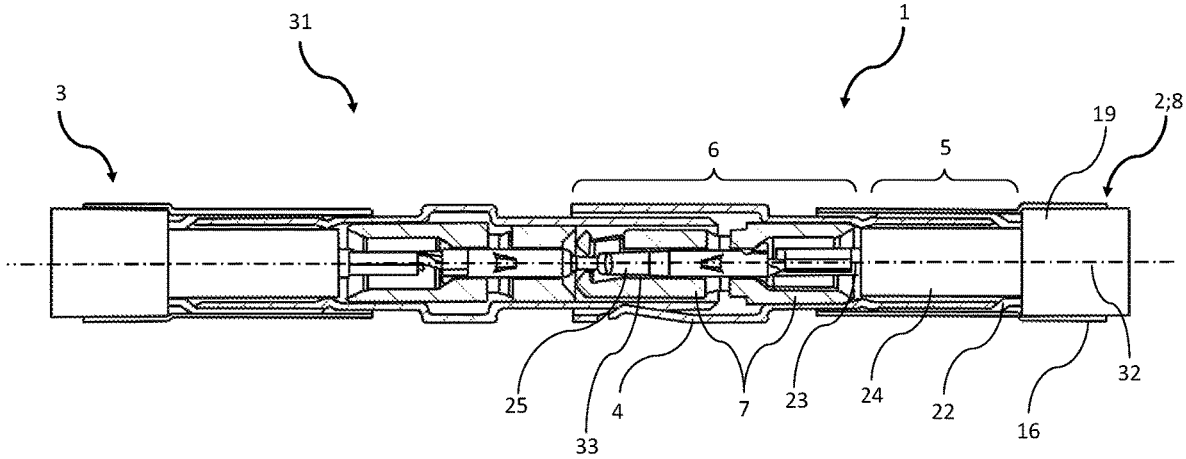
FIG. 1 is a sectional view of a first embodiment of the connector assembly according to the invention.

In an embodiment, the present invention overcomes at least one of the disadvantages of the above-mentioned prior art and provides a releasable connector assembly for connecting cables, in particular radio-frequency cables, to an electrical component, such as another cable or a semiconductor circuit board, where the transmission quality of the signals to be transmitted is impaired to the least extent possible.

A connector assembly according to an embodiment of the invention is suitable for connecting a cable to an electrical component. In this context, an electrical component may be understood to be, for example, a semiconductor circuit board or another cable to which the cable is to be connected. The cable may be a cable having only one inner conductor, such as a coaxial cable, as well as a cable having a plurality of inner conductors. In addition to the internal conductor, the cable may have a dielectric and a shield, it being preferred that the dielectric be disposed between the inner conductor and the shield. The connector assembly includes an outer conductor sleeve having an attachment portion and a plug portion. In the plug portion, the outer conductor sleeve can be releasably connected to a corresponding mating plug. The mating plug may, for example, also be an outer conductor sleeve which is selected, in terms of its dimensioning, such that the outer conductor sleeves can be frictionally and/or interlockingly connected together, for example, by inserting them into one another. Disposed within the outer conductor sleeve is an insulator element, which is at least partially disposed in the plug portion. Thus, the insulator element is at least partially enclosed by the outer conductor sleeve. The outer conductor sleeve is preferably made of an electrically conductive material and has a round, in particular circular or elliptical, cross section. Preferably, the insulator element is disposed with its longitudinal axis coaxial with the outer conductor sleeve. The cable has a cable end portion which is at least partially disposed within the outer conductor sleeve in the attachment portion. Thus, the cable end portion is at least partially enclosed by the outer conductor sleeve. In addition, the cable may be at least partially stripped in the cable end portion, so that, for example, only a dielectric and/or a shield and/or an inner conductor may be disposed within the outer conductor sleeve. It is preferred here that at least the inner conductor and the dielectric be disposed in the attachment portion, it being possible that the inner conductor may extend into the plug portion.

In the attachment portion, the outer conductor sleeve has at least a first wall thickness region having a first wall thickness. The first wall thickness region may extend both over the entire attachment portion and only over part of the attachment portion. In the plug portion, the outer conductor sleeve has at least a second wall thickness region having a second wall thickness. The second wall thickness region may extend either over the entire plug portion or only over a part thereof. In this connection, it is preferred that the first and/or second wall thickness region(s) extend uniformly, in particular like a band, about a central axis of the outer conductor sleeve. The first wall thickness in the first wall thickness region is greater; i.e., thicker, than the second wall thickness in the second wall thickness region. Furthermore, the insulator element is at least partially disposed within the second wall thickness region.

Since the outer conductor sleeve has, at least in the attachment portion, a first wall thickness region having a first wall thickness that is greater than the second wall thickness in the second wall thickness region located in the plug portion, the outer conductor sleeve is capable of meeting a wide variety of demands. In the attachment portion, the outer conductor sleeve must be particularly rugged, in particular to permit attachment to the cable, for example by crimping. This is made possible by the greater first wall thickness. In the plug portion, where lesser loads are expected, the smaller wall thickness allows the outer conductor sleeve, in combination with the insulator element and an inner conductor element disposed in the insulator element, to be more effectively matched to a desired impedance.

The first and second wall thickness regions may be produced, for example, by producing, in a first step, a developed blank of the outer conductor sleeve. The developed blank may be produced, for example, by punching. The first and/or second wall thickness region(s) may then be incorporated into the developed blank of the outer conductor sleeve. This may be accomplished, for example, by stamping. Subsequently, the developed blank may be shaped into the inventive outer conductor sleeve.

In the second wall thickness region, the insulator element may, at least along a certain length thereof, be spaced from an inner wall of the outer conductor sleeve. Preferably, the spacing between the outer conductor sleeve and the insulator element is constant throughout the second wall thickness region. The spacing between the outer conductor sleeve and the insulator element may be achieved, for example, by a spacer. The spacer may, for example, be an intermediate layer disposed between the outer conductor sleeve and the insulator element. Furthermore, in the plug portion, the outer conductor sleeve may have a retaining region by which the outer conductor sleeve is frictionally and/or interlockingly connected to the insulator element. The insulator element may be disposed coaxially with the outer conductor sleeve, at least in the second wall thickness region.

It is particularly preferred here that an air gap be formed between the insulator element and the inner wall of the outer conductor sleeve, at least in the second wall thickness region. The air gap between the insulator element and the outer conductor sleeve is preferably constant in the second wall thickness region.

The outer conductor sleeve may be of a uniform (i.e., identical) outer diameter in the first wall thickness region and in the second wall thickness region. In this case, since the first wall thickness is greater than the second wall thickness, the outer conductor sleeve may have an inner diameter in the first wall thickness region that is smaller than the inner diameter of the outer conductor sleeve in the second wall thickness region. Furthermore, even if the outer conductor sleeve has different outer diameters in the first wall thickness region and in the second wall thickness region, it may have a smaller inner diameter in the first wall thickness region than in the second wall thickness region.

The first wall thickness region may have a wall thickness of 0.15 to 0.3 millimeters, a wall thickness of 0.22 to 0.27 millimeters being particularly preferred. Furthermore, the first wall thickness may be 10 to 50%, more preferably 15% to 25%, greater than the second wall thickness.

The first wall thickness in the first wall thickness region and/or the second wall thickness in the second wall thickness region may be constant. This may be understood to mean that the first and/or second wall thickness(es) do not/does not change throughout the first and/or second wall thickness region(s). Accordingly, the first and/or second wall thickness region(s) may be defined by the region in which the outer conductor sleeve has the first or the second wall thickness.

Furthermore, in the plug portion, the outer conductor sleeve may have a third wall thickness region having a third wall thickness that differs from at least the second wall thickness. In this connection, it is preferred that the third wall thickness be greater than at least the second wall thickness. Moreover, the third wall thickness may be equal to the first wall thickness. In addition, it is particularly preferred that the third wall thickness in the third wall thickness region be constant.

The cable end portion of the cable may be connected to the outer conductor sleeve by a compression tube. The compression tube is preferably seamless. The compression tube may have a first tube portion connected to at least the attachment portion of the outer conductor sleeve. The first tube portion may additionally be connected to the plug portion. In particular, the first tube portion may extend over the first and second wall thickness regions. Furthermore, the compression tube may have a second tube portion connected to a cable jacket of the cable. A cable jacket may be understood to be an insulating layer. Thus, the cable jacket may form the outermost layer of the cable. The compression tube is frictionally and/or interlockingly connected to the outer conductor sleeve in the attachment portion and to the cable jacket.

The compression tube may have a step between the first tube portion and the second tube portion. The step is preferably configured such that the compression tube has a smaller outer diameter in the first tube portion than in the second tube portion. Furthermore, the step extends on an outer surface of the compression tube perpendicularly to the longitudinal axis of the compression tube, particularly preferably around the entire circumference thereof.

In practice, it has been found that during crimping of cables, and in particular of coaxial cables, to corresponding connection partners, the circular shape and the coaxial arrangement of the shield, the dielectric, and the inner conductor can only very rarely be ensured in the area of the cable where the cable is crimped. This is because the deformation of the cable in the crimping area can be controlled only to a limited extent, so that, in most cases, the cable is deformed out of its round, coaxial shape. This may entail considerable disadvantages with respect to line impedance. Therefore, the compression tube has preferably at least twelve, more preferably at least sixteen, pressing surfaces at which the compression tube is frictionally and/or interlockingly connected in the first tube portion to the attachment portion of the outer conductor sleeve and in the second tube portion to the cable jacket of the cable. The at least twelve, more preferably sixteen, pressing surfaces allow the cable and the outer conductor sleeve to be deformed to a shape very close to a circular and coaxial shape, thus making it possible to reduce the risk of unwanted variations in terms of line impedance. The pressing surfaces are preferably equal in length and width and particularly preferably have a constant length and width. Furthermore, it may be preferred that the pressing surfaces be uniformly distributed about the longitudinal axis of the compression tube.

If the cable includes a shield, such shield may be disposed between the compression tube and the outer conductor sleeve in the end portion of the cable. In this case, the shield is preferably widened so that the attachment portion of the outer conductor sleeve is at least partially disposed between the dielectric and the shield. The shield may be frictionally or interlockingly connected to the compression tube and/or to the attachment portion.

The outer conductor sleeve may have stamped grooves on an outer wall in the attachment portion, which stamped grooves are preferably arranged parallel to one another. In addition, the stamped grooves may be arranged equidistantly from one another. The stamped grooves preferably extend perpendicularly to the longitudinal axis of the outer conductor sleeve and may be closed to form an annulus. The stamped grooves may be stamped to different depths. The stamped grooves make it possible to improve the connection between the attachment portion of the outer conductor sleeve and the compression tube. In particular, if a shield is disposed between the compression tube and the attachment portion, the stamped grooves can significantly improve the connection between the compression tube, the shield, and the attachment portion.

The outer conductor sleeve may have at least one tapered portion having an inner taper diameter between the attachment portion and the plug portion. The inner taper diameter is preferably smaller than a smallest inner diameter of the outer conductor sleeve in the attachment portion. The tapered portion may be formed by one or more projections on the inner wall of the outer conductor sleeve, the one or more projections being arranged preferably perpendicularly to the longitudinal axis of the outer conductor and preferably annularly on the inner wall. The projections may be incorporated by depositing material on the inner wall or by selectively shaping the outer conductor sleeve, such as by stamping. The projection is particularly preferably shaped such that a ramp is formed in the tapered portion, which ramp slopes upwardly from the attachment portion to the inner taper diameter.

The insulator element may have an inner conductor channel for accommodating the inner conductor or an inner conductor contact, the diameter of the inner conductor channel at the end of the insulator element that faces toward the tapered portion being equal to or greater than the inner taper diameter.

For purposes of securing the outer conductor sleeve in a plug housing, the outer conductor sleeve may have a circumferential locking groove. The locking groove is preferably disposed in the second wall thickness region and preferably extends on the outer wall of the outer conductor sleeve perpendicularly about the longitudinal axis of the outer conductor sleeve. At least one side surface of the groove may be formed by a front edge of the compression tube. The locking groove may also be formed by a stamped formation in the outer conductor sleeve or by one or more step changes in the diameter of the outer conductor sleeve. It is most preferred here that one side surface of the locking groove be formed by the front edge of the compression tube and that another side surface be formed by a step change from a smaller diameter to a larger diameter in the outer conductor sleeve. In this context, a step change in diameter may be understood to be an abrupt increase or decrease in the outer diameter of the outer conductor sleeve along the longitudinal axis of the outer conductor sleeve.

The cable may be disposed with the dielectric in the cable end portion within the outer conductor sleeve in the attachment portion. In this connection, it is preferred that the dielectric be spaced from the outer conductor sleeve. Preferably, the spacing of the dielectric from the outer conductor sleeve is selected to be constant. The dielectric may extend into the tapered portion. Therefore, it is preferred that the dielectric have an outer diameter smaller than a smallest inner diameter of the tapered portion.

FIG. 1 shows, in sectional view, a first embodiment of a connector assembly 1 according to the invention. The sectional plane extends along a longitudinal axis 32 of connector assembly 1. Connector assembly 1 is composed of an outer conductor sleeve 4, an insulator element 7, and an inner conductor contact 25. In the present exemplary embodiment, outer conductor sleeve 4 is made of metal and includes an attachment portion 5 and a plug portion 6. Connector assembly 1 is connected to a cable 2. Cable 2 includes an inner conductor 23 and a shield 22 which, in the present exemplary embodiment, serves as an outer conductor. A dielectric 24 is disposed between inner conductor 23 and shield 22. A cable jacket 19 protects cable 2 from external influences. Cable 2 is disposed with inner conductor 23 and dielectric 24 within outer conductor sleeve 4, dielectric 24 extending into attachment portion 5 and inner conductor 23 extending into plug portion 6, where inner conductor 23 is crimped to inner conductor contact 25. In attachment portion 5, dielectric 24 is spaced from outer conductor sleeve 4. Shield 22 is widened so that outer conductor sleeve 4 is disposed between shield 22 and dielectric 24 in cable end portion 8. A compression tube 16 is crimped to cable jacket 19 of cable 2 and to attachment portion 5 of the outer conductor sleeve so that cable 2 and outer conductor sleeve 4 are permanently connected together. In the present exemplary embodiment, compression tube 16 extends beyond attachment portion 5 and into plug portion 6.

In plug portion 6, insulator element 7 is disposed within outer conductor sleeve 4. The insulator element has an inner conductor channel 33, in which are disposed inner conductor contact 25 and a portion of inner conductor 23. In this figure, the inventive connector assembly 1 is shown in a plugged position. Outer conductor sleeve 4 and inner conductor contact 25 are in electrically conductive connection with a mating connector 31. To this end, mating connector 31 is inserted into plug portion 6. Mating connector 31 is connected to an electrical component 3 which, in the present exemplary embodiment, is also a cable.

Figure 2:
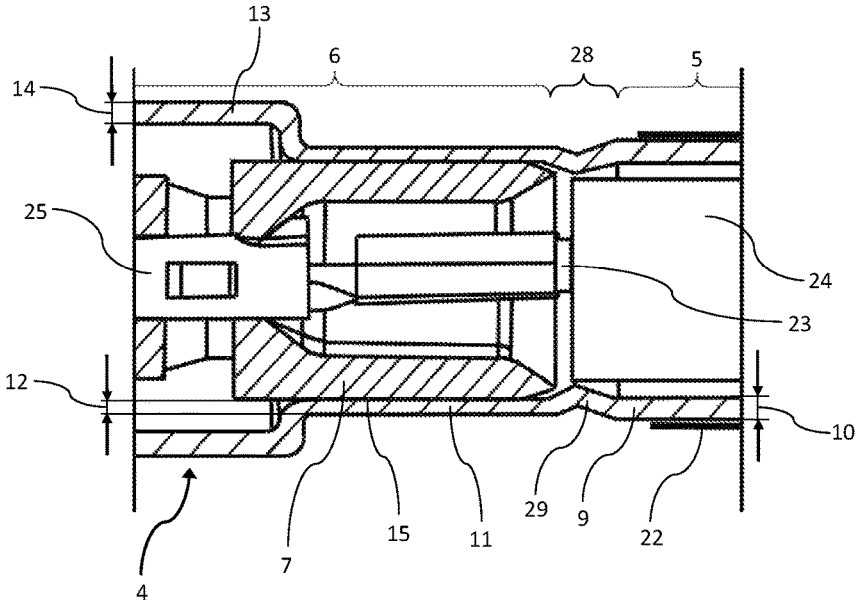
FIG. 2 is an enlarged sectional view of the first embodiment of the connector assembly according to the invention.

FIG. 2 shows the first embodiment in an enlarged sectional view. For the sake of clarity, the compression tube is not shown in the illustrated view. Connecting portion 5 has a first wall thickness region 9 having a first wall thickness 10. First wall thickness region 9 extends uniformly throughout attachment portion 5 so that the entire attachment portion 5 has the first wall thickness 10. First wall thickness 10 is 0.23 millimeters. In the present exemplary embodiment, attachment portion 5 is adjoined by a tapered portion 28. In tapered portion 28, outer conductor sleeve 4 tapers to an inner diameter which, in the present exemplary embodiment, is the smallest inner diameter of outer conductor sleeve 4, but is greater than the outer diameter of dielectric 24 of cable 2. The taper is created by a projection 29 formed on inner wall 15 of outer conductor sleeve 4 in tapered portion 28. In the present exemplary embodiment, projection 29 is formed by a circumferential stamped formation in outer conductor sleeve 4 in tapered portion 28.

Tapered portion 28 is adjoined by plug portion 6 with a second wall thickness region 11. Second wall thickness region 11 has a second wall thickness 12 that is 0.04 millimeters smaller than first wall thickness 10 and, consequently, is 0.19 millimeters. Insulator element 7 is disposed within second wall thickness region 11. Owing to the smaller second wall thickness, a space is created between insulator element 7 and inner wall 15. In the present exemplary embodiment, this space forms an air gap between insulator element 7 and outer conductor sleeve 4. Since insulator element 7 is disposed coaxially with outer conductor sleeve 4, a uniform space, and thus a uniform air gap, is formed between insulator element 7 and inner wall 15 in the second wall thickness region. In second wall thickness region 11, the outer conductor sleeve has a greater inner diameter but a smaller outer diameter than in first wall thickness region 9.

In the present exemplary embodiment, plug portion 6 has a third wall thickness region 13 having a third wall thickness 14 and adjoining second wall thickness region 11. Third wall thickness 14 is 0.23 millimeters, and thus is equal to first wall thickness 10. In third wall thickness region 13, outer conductor sleeve 4 has an inner and outer diameter which are greater than the inner and outer diameters of first and second wall thickness regions 9, 11 in order to allow outer conductor sleeve 4 to be secured in a plug housing.

Figure 3:
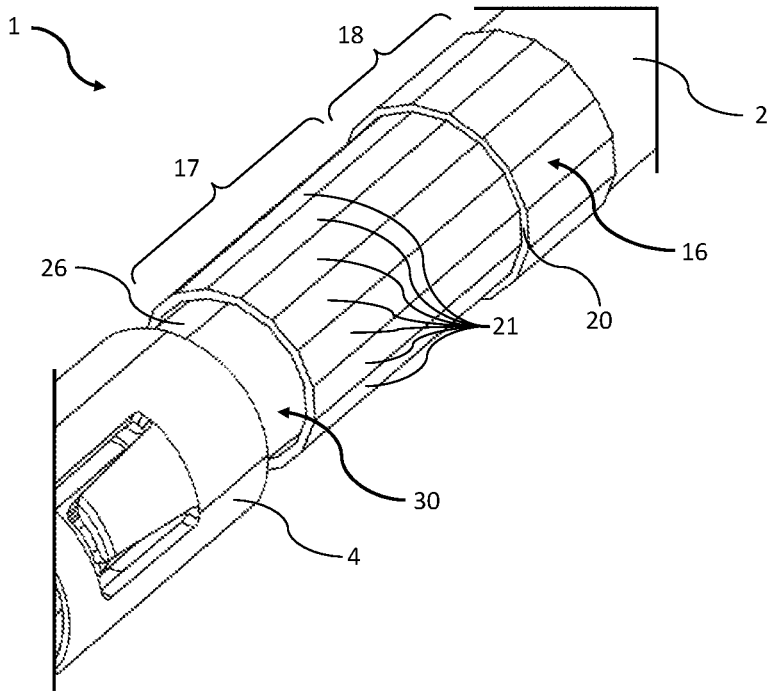
FIG. 3 is a three-dimensional view of the first embodiment of the connector assembly according to the invention.

FIG. 3 shows a three-dimensional view of the first embodiment. Compression tube 16, which connects outer conductor sleeve 4 to cable 2, has a first tube portion 17 and a second tube portion 18. In first tube portion 17, compression tube 16 is permanently connected to outer conductor sleeve 4 by crimping. In second tube portion 18, compression tube 16 is permanently connected to cable jacket 19 of cable 2. A step 20 is formed between the first and second tube portions 17, 18. In the present exemplary embodiment, step 20 was formed by compressing compression tube 16 to a greater extent in first tube portion 17 than in second tube portion 18. In the present exemplary embodiment, first and second tube portions 17, 18 have sixteen pressing surfaces 21, which are equal in length and width and uniformly distributed around compression tube 16. Disposed adjacent to compression tube 16 is a locking groove 30 which serves for interlocking attachment to a plug housing. In the present exemplary embodiment, locking groove 30 is formed by an end face of compression tube 16, outer wall 26 of outer conductor sleeve 4, and a step change in the diameter of outer conductor sleeve 4.

Figure 4:
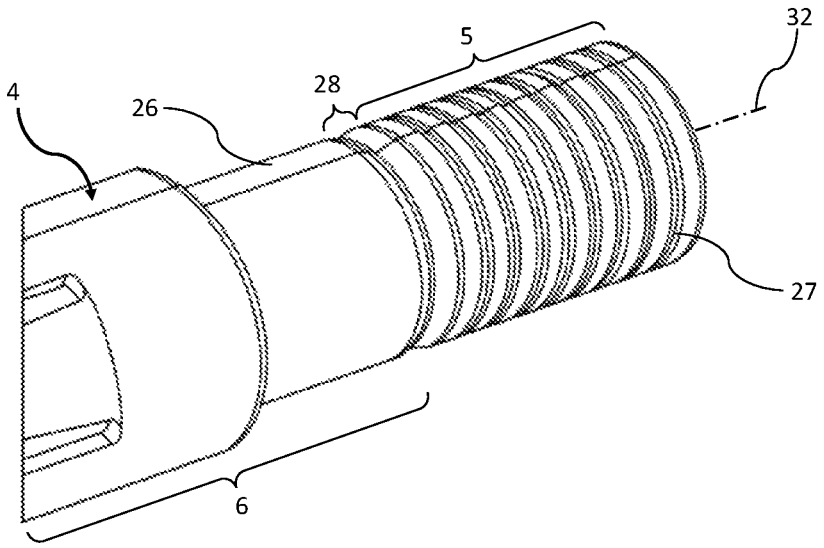
FIG. 4 is a three-dimensional view of a second embodiment of the connector assembly.

FIG. 4 shows a three-dimensional view of outer conductor sleeve 4 in accordance with a second embodiment. Outer conductor sleeve 4 has a plurality of stamped grooves 27 in attachment portion 5. Stamped grooves 27 are arranged parallel to, and uniformly spaced from, one another, and perpendicularly to longitudinal axis 32 of outer conductor sleeve 4. Thus, stamped grooves 27 form annuli extending about longitudinal axis 32 in the attachment portion.

The explanations provided with regard to the figures are merely for the sake of illustration and are not to be construed as limiting.

While embodiments of the invention have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 connector assembly
2 cable
3 electrical component
4 outer conductor sleeve
5 attachment portion
6 plug portion
7 insulator element
8 cable end portion
9 first wall thickness region
10 first wall thickness
11 second wall thickness region
12 second wall thickness
13 third wall thickness region
14 third wall thickness
15 inner wall of the outer conductor sleeve
16 compression tube
17 first tube portion
18 second tube portion
19 cable jacket
20 step
21 pressing surfaces
22 shield
23 inner conductor
24 dielectric
25 inner conductor contact
26 outer wall
27 stamped grooves
28 tapered portion
29 projection
30 locking groove

31 mating connector
32 longitudinal axis
33 inner conductor channel

What is claimed is:

1. A connector assembly for connecting a cable to an electrical component, the connector assembly comprising:
an outer conductor sleeve having an attachment portion and a plug portion; and
an insulator element disposed within the outer conductor sleeve, at least partially in the plug portion;
wherein the cable is disposed with a cable end portion at least partially within the outer conductor sleeve in the attachment portion,
wherein the outer conductor sleeve has at least a first wall thickness region having a first wall thickness in the attachment portion and at least a second wall thickness region having a second wall thickness in the plug portion, the first wall thickness being greater than the second wall thickness,
wherein the insulator element is at least partially disposed in the second wall thickness region,
wherein the outer conductor sleeve has a same outer diameter in the first wall thickness region and in the second wall thickness region, and
wherein the outer conductor sleeve is formed as one integral piece.

2. The connector assembly as recited in claim 1, wherein the first wall thickness is 0.15 to 0.3 millimeters.

3. The connector assembly as recited in claim 1, wherein the first wall thickness is 10% to 50% greater than the second wall thickness.

4. The connector assembly as recited in claim 1, wherein the first wall thickness in the first wall thickness region and/or the second wall thickness in the second wall thickness region are/is constant.

5. The connector assembly as recited in claim 1, wherein the plug portion has a third wall thickness region having a third wall thickness that differs from at least the second wall thickness.

6. The connector assembly as recited in claim 1, wherein the cable end portion is connected by a seamless compression tube to the outer conductor sleeve by a first tube section connected at least to the attachment portion and a second tube portion connected to a cable jacket of the cable.

7. The connector assembly as recited in claim 6, wherein the compression tube has a step between the first and second tube portions.

8. The connector assembly blade as recited in claim 6, wherein the compression tube has at least twelve pressing surfaces.

9. The connector assembly as recited in claim 6, wherein the cable includes a shield which, in the cable end portion, is disposed between the compression tube and the outer conductor sleeve.

10. The connector assembly as recited in claim 1, wherein the outer conductor sleeve has stamped grooves on an outer wall in the attachment portion, the stamped grooves being arranged parallel to one another.

11. The connector assembly as recited in claim 1, wherein, for securing the outer conductor sleeve in a plug housing, the outer conductor sleeve has a circumferential locking groove, which is at least partially disposed in the second wall thickness region.

12. The connector assembly as recited in claim 1, wherein the cable has a dielectric which, in the cable end portion, is disposed in the attachment portion and spaced from the outer conductor sleeve.

13. The connector assembly as recited in claim 12, wherein the plug portion does not include the dielectric.

14. The connector assembly as recited in claim 1, wherein the attachment portion extends from a first side at an end of a jacket of the cable along a dielectric of the cable to a second side, and wherein an end of the dielectric is disposed at the second side of the attachment portion or in a tapered portion that connects the plug portion and the attachment portion to each other.

15. The connector assembly as recited in claim 1, wherein the connector assembly is crimped to the cable.

16. A connector assembly for connecting a cable to an electrical component, the connector assembly comprising:
an outer conductor sleeve having an attachment portion and a plug portion; and
an insulator element disposed within the outer conductor sleeve, at least partially in the plug portion;
wherein the cable is disposed with a cable end portion at least partially within the outer conductor sleeve in the attachment portion,
wherein the outer conductor sleeve has at least a first wall thickness region having a first wall thickness in the attachment portion and at least a second wall thickness region having a second wall thickness in the plug portion, the first wall thickness being greater than the second wall thickness,
wherein the insulator element is at least partially disposed in the second wall thickness region,
wherein the outer conductor sleeve has a same outer diameter in the first wall thickness region and in the second wall thickness region, and
wherein the outer conductor sleeve has, between the attachment portion and the plug portion, at least one tapered portion having an inner taper diameter that is smaller than a smallest inner diameter of the attachment portion.

17. A connector assembly for connecting a cable to an electrical component, the connector assembly comprising:
an outer conductor sleeve having an attachment portion and a plug portion; and
an insulator element disposed within the outer conductor sleeve, at least partially in the plug portion;
wherein the cable is disposed with a cable end portion at least partially within the outer conductor sleeve in the attachment portion,
wherein the outer conductor sleeve has at least a first wall thickness region having a first wall thickness in the attachment portion and at least a second wall thickness region having a second wall thickness in the plug portion, the first wall thickness being greater than the second wall thickness,
wherein the insulator element is at least partially disposed in the second wall thickness region,
wherein the outer conductor sleeve has a same outer diameter in the first wall thickness region and in the second wall thickness region, and
wherein the plug portion and the attachment portion are connected by a tapered portion having an inward projection such that the tapered portion has a smaller inner diameter than the plug portion and the attachment portion.

18. A connector assembly for connecting a cable to an electrical component, the connector assembly comprising:
an outer conductor sleeve having an attachment portion and a plug portion; and
an insulator element disposed within the outer conductor sleeve, at least partially in the plug portion;

wherein the cable is disposed with a cable end portion at least partially within the outer conductor sleeve in the attachment portion, wherein the outer conductor sleeve has at least a first wall thickness region having a first wall thickness in the attachment portion and at least a second wall thickness region having a second wall thickness in the plug portion, the first wall thickness being greater than the second wall thickness, wherein the insulator element is at least partially disposed in the second wall thickness region, wherein the outer conductor sleeve has a same outer diameter in the first wall thickness region and in the second wall thickness region, wherein the attachment portion extends from a first side at an end of a jacket of the cable along a dielectric of the cable to a second side, and wherein an end of the dielectric is disposed at the second side of the attachment portion or in a tapered portion that connects the plug portion and the attachment portion to each other, and wherein the first wall thickness region extends uniformly throughout an entirety of the attachment portion such that the entirety of the attachment portion has the first wall thickness.

19. The connector assembly as recited in claim 18, wherein the entirety of the attachment portion has a same outer diameter.

* * * * *